US010040602B1

(12) United States Patent
Talgo

(10) Patent No.: US 10,040,602 B1
(45) Date of Patent: Aug. 7, 2018

(54) EXPANDABLE CONTAINER

(71) Applicant: Walter R. Talgo, Knoxville, TN (US)

(72) Inventor: Walter R. Talgo, Knoxville, TN (US)

( * ) Notice: Subject to any disclaimer, the term of this patent is extended or adjusted under 35 U.S.C. 154(b) by 0 days.

(21) Appl. No.: 14/857,866

(22) Filed: Sep. 18, 2015

Related U.S. Application Data

(60) Provisional application No. 62/053,434, filed on Sep. 22, 2014.

(51) Int. Cl.

| | |
|---|---|
| ***B65D 8/14*** | (2006.01) |
| ***B65D 21/08*** | (2006.01) |
| ***B65D 25/54*** | (2006.01) |
| ***B65D 25/28*** | (2006.01) |
| ***B65D 41/04*** | (2006.01) |

(52) U.S. Cl.
CPC ..... *B65D 21/086* (2013.01); *B65D 25/2826* (2013.01); *B65D 25/54* (2013.01); *B65D 41/04* (2013.01)

(58) Field of Classification Search
CPC ..... B65D 21/086; B65D 25/54; B65D 25/56
USPC ..... 220/662, 663, 666; 215/379
See application file for complete search history.

(56) References Cited

U.S. PATENT DOCUMENTS

| | | | | |
|---|---|---|---|---|
| 2,151,469 A | | 3/1939 | Hochtheil | |
| 2,685,316 A | | 8/1954 | Krasno | |
| 3,325,061 A | * | 6/1967 | Ellsworth | A61M 5/3137 222/386 |
| 3,411,691 A | | 11/1968 | Whitaker et al. | |
| 3,891,555 A | * | 6/1975 | Bennett | A01K 63/045 148/DIG. 43 |
| 4,262,669 A | | 4/1981 | Sneider | |
| 4,592,492 A | * | 6/1986 | Tidmore | B65D 1/323 222/209 |
| 4,702,385 A | * | 10/1987 | Shillington | 220/210 |
| 4,805,680 A | * | 2/1989 | Ueno | A45C 11/182 150/145 |
| 4,860,892 A | * | 8/1989 | Roberts | G03C 3/00 206/389 |
| 4,874,115 A | * | 10/1989 | Weihrauch | B65D 83/0005 222/386 |
| 5,133,481 A | | 7/1992 | Mayfield et al. | |
| 5,449,088 A | * | 9/1995 | Howard | B65D 25/56 220/662 |

(Continued)

FOREIGN PATENT DOCUMENTS

| | | |
|---|---|---|
| EP | 0609348 A1 | 8/1994 |
| EP | 0666222 A1 | 8/1995 |

OTHER PUBLICATIONS

Burple. Product listing [online]. Memory Glands 2015 [Published on Oct. 26, 2011]. Retrieved from the Internet:<http://http://memoryglands.com/burple>.

*Primary Examiner* — Andrew T Kirsch
*Assistant Examiner* — Don M Anderson
(74) *Attorney, Agent, or Firm* — Cramer Patent & Design, PLLC; Aaron R. Cramer

(57) ABSTRACT

A container is provided having a pleated sidewall construction enabling expansion and contraction of an internal volume. A bottom of the container is provided with stabilizers to assist with maintaining the container in an up-right position when expanding and contracting the container. The container is especially useful for concentrated liquids which require the addition of a secondary liquid such as water.

9 Claims, 3 Drawing Sheets

(56) References Cited

U.S. PATENT DOCUMENTS 5,464,107 A * 11/1995 Koeniger ..... B29C 47/0023 215/12.2
5,683,369 A 11/1997 Tsukada
5,722,570 A 3/1998 Sultzer, III et al.
5,762,230 A * 6/1998 Policappelli ..... B65D 1/16 220/62.12
5,765,708 A * 6/1998 Fragos ..... B65D 1/0292 220/8
5,862,940 A * 1/1999 Chism ..... B65D 37/00 220/666
5,911,338 A * 6/1999 Miller ..... B65D 21/086 220/666
5,975,380 A 11/1999 West, Jr.
6,047,848 A * 4/2000 Davis ..... B65D 1/0292 215/382
6,053,400 A 4/2000 Rea
6,334,543 B1 * 1/2002 Abbondandolo .... B65D 21/086 215/382
6,763,973 B1 * 7/2004 Hudkins ..... B65D 21/023 222/1
6,899,239 B1 * 5/2005 Gray ..... A61J 9/001 215/11.3
7,866,500 B1 * 1/2011 Peggs ..... B65D 21/0228 220/4.26
8,556,099 B2 * 10/2013 Perlman ..... A45F 3/20 206/217
2004/0069740 A1 * 4/2004 Athalye ..... B65D 1/0292 215/381
2007/0158352 A1 * 7/2007 Cheng ..... B65D 25/54 220/662
2007/0187289 A1 8/2007 Markson et al.
2009/0026216 A1 * 1/2009 Philpott ..... B65D 21/086 220/666
2009/0246077 A1 * 10/2009 Lu ..... B01D 7/00 422/400
2010/0108698 A1 * 5/2010 Daliri ..... B65D 21/086 220/666
2011/0204050 A1 * 8/2011 Liput ..... A47J 47/10 220/7
2011/0253728 A1 * 10/2011 Steele ..... B65D 21/086 220/666
2011/0284547 A1 * 11/2011 McElligott ..... B65D 21/086 220/495.03
2012/0292284 A1 11/2012 Melrose
2013/0097973 A1 * 4/2013 McCoy ..... B65D 1/02 53/467
2014/0361010 A1 * 12/2014 Qiu ..... B65D 21/086 220/200
2015/0217900 A1 * 8/2015 Poulin ..... A61J 9/005 215/11.1
2016/0059990 A1 * 3/2016 Patikas-Bryant .... B65D 21/086 220/523

* cited by examiner

EXPANDABLE CONTAINER

RELATED APPLICATIONS

The present invention was first described in and claims the benefit of U.S. Provisional Application No. 62/053,434 filed Sep. 22, 2014, the entire disclosures of which are incorporated herein by reference.

FIELD OF THE INVENTION

The present invention relates generally to a container enabling expansion and contraction of an internal volume.

BACKGROUND OF THE INVENTION

There are a wide variety of liquid products that are sold in a concentrated state. These products include anti-freeze, soaps, liquid cleaning agents, juices, and the like. These concentrates usually recommend the user add an additional amount of water, usually in amount corresponding to a given ratio, usually the ratio is one-to-one ratio (1:1). This practice allows for cost savings associated with not having to add the water at the point of production. This saves on the cost of the water, the cost of the shipping and ultimately the saving of retail shelving space.

Unfortunately, the task of adding water after purchase leads to frustration on the part of the user. Firstly, one must find another larger container to use for mixing the water and product together. Secondly, another container may be necessary for storing any unused product afterwards. Thirdly, there is the risk the mixed product may end up being mislabeled or even not labeled. Fourthly, the mixing process itself is often messy. Finally, it is too easy to add too much, or not enough water resulting in an inferior final product.

Accordingly, there exists a need for a means by which concentrated liquids can be easily bottled, transported and sold in an effort to address the above mentioned problems. The use of the expandable container allows one to purchase, mix, and use concentrated liquid products in a manner which is quick, easy, and effective.

SUMMARY OF THE INVENTION

The inventor has recognized the aforementioned inherent problems and lack in the art and observed that there is a need for an expandable container.

It is therefore an object of the invention to provide a container, comprising a container body which is comprised of an upper section, a lower section and an expandable section between the upper and lower sections. The container also has a lid located at a top of the upper section, thereby providing access to an interior wherein the expandable section enables the container body to be either expanded or retracted. When the container body is fully collapsed, the container body is capable of holding up to one-half (½) of a liquid capacity as when fully expanded.

There is a window located along a side surface of the upper section for providing visual access to contents held within the interior. The window comprises a plurality of molded or painted measurement graduations. The expandable section includes a plurality of integrally-molded parallel pleats. There is a handle within the upper section of the container. The handle is "L"-shaped. The handle may be integrally formed within the upper section. The lid is threadingly affixed and sealed to a neck portion of the container located at a top of the upper section. The container may have at least one (1) stabilizing flange integrally formed on a lower portion of the lower section of the container.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
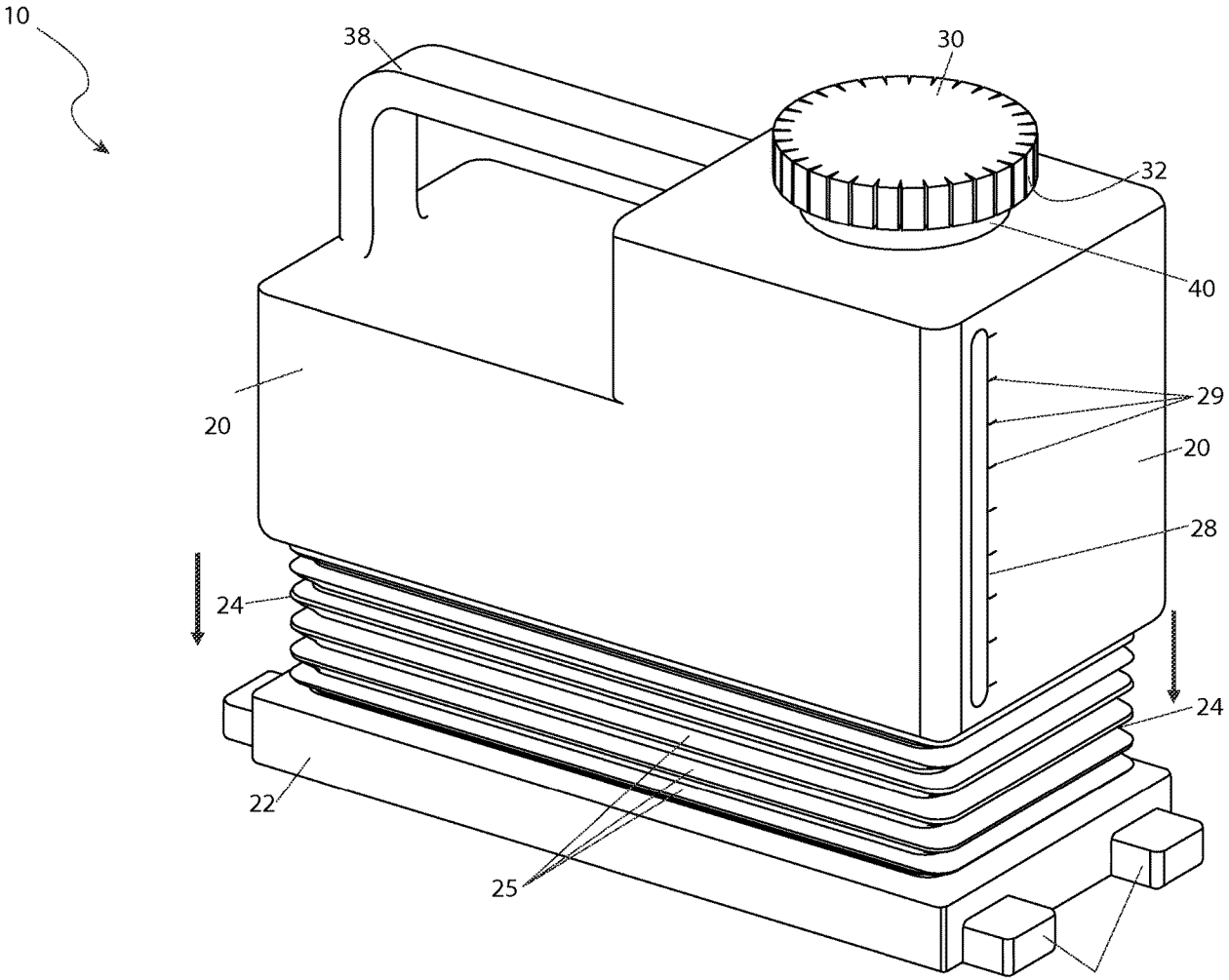
FIG. 1 is a perspective view of an expandable container 10 depicting an expanded state, according to a preferred embodiment of the present invention.

10 expandable container
20 upper vessel section
22 lower vessel section
24 expandable section
25 pleat
26 internal volume
28 liquid level window
29 graduation
30 lid
32 grip
38 handle
40 neck
42 threaded region
50 flange
100 liquid

DETAILED DESCRIPTION OF THE PREFERRED EMBODIMENT

Figure 2:
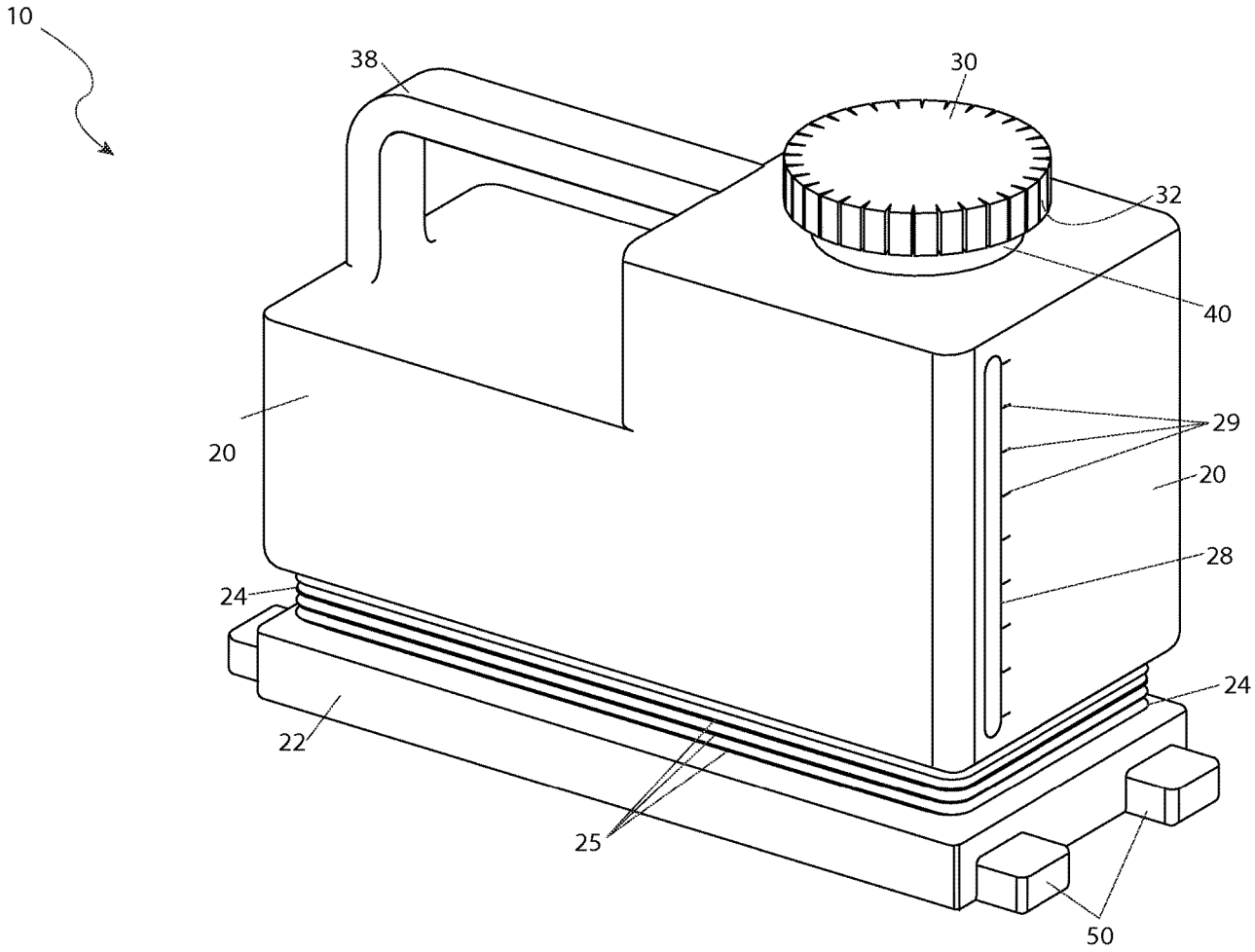
FIG. 2 is another perspective view of the expandable container 10 depicting a collapsed state, according to a preferred embodiment of the present invention; and, FIG. 3 is a sectional view of the expandable container 10 taken along section line A-A (see FIG. 1), according to a preferred embodiment of the present invention.
Figure 3:
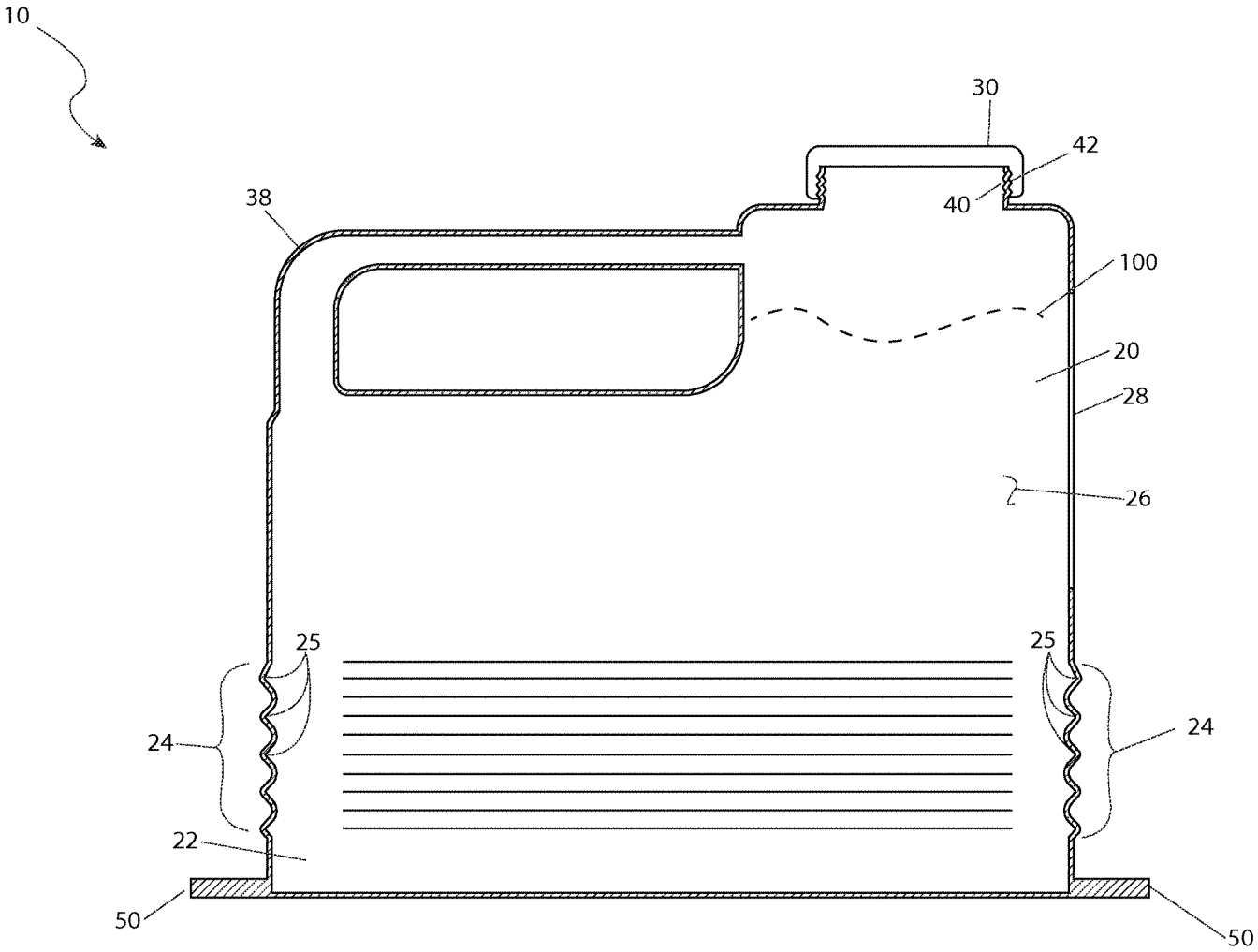

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an expandable container (herein described as the "device") 10, preferably for providing a plastic liquid container for use in the distribution and sale of concentrated liquids 100 that require the addition of a secondary liquid such as water by the final consumer.

Referring now to FIGS. 1 and 2, perspective views of the device 10 depicting expanded and collapsed states, respectively, according to the preferred embodiment of the present invention, are disclosed. The device 10 provides a molded plastic container made of flexible plastic sections having a middle accordion-like expandable section 24. In its collapsed state, the device 10 is capable of holding approximately one-half (½) of the liquid capacity of the expanded state.

The device 10 includes an upper vessel section 20 and a lower vessel section 22, having the expandable section 24 in between which extends all around the device 10 along a horizontal plane. Additionally, the device 10 includes a liquid level window 28, a filling lid 30 along a top surface, an integral "L"-shaped carrying handle 38, and a plurality of stabilizing flanges 50 which provide a means to stabilize the device 10 during transformation between collapsed and expanded states. The liquid level window 28 is envisioned to be a transparent vertical strip located along a side surface of the upper vessel section 20 and is envisioned to provide molded or painted graduations 29 allowing a user to produce an accurate mixture.

The expandable section 24 includes a plurality of integrally-molded parallel pleats 25 which expand upwardly to increase an internal volume 26 of the device 10 (see FIG. 3). The pleats 25 are envisioned to assume a self-locking form when fully expanded so as to maintain the expanded state until a user presses downwardly upon the upper vessel section 20 to return the device 10 to restore the device 10 to the collapsed state. A preferred embodiment of the lid 30 is shown here being of a circular design being threadingly affixed and sealed to a neck portion 40 of the upper vessel section 20, and having a gripping surface 32 along side surfaces for easy removal of the lid 30; however, it is understood that various lid designs may be provided without deviating from the teachings of the device 10, and as such should not be interpreted as a limiting factor of the invention.

It is envisioned that the device 10 would be used to contain a primary concentrated liquid product 100 such as anti-freeze, soap, shampoos, cleaners, and other products. It is envisioned that the device 10 would be introduced in a variety of volumetric sizes such as, but not limited to: one-half gallon (½ gal.), one gallon (1 gal), and the like. The features of the device 10 are intended to save space while transporting, shipping and selling the contained product, yet allowing for easy use by the consumer without having to utilize additional containers while performing a liquid mixing operation, or risking adding too much or not enough secondary liquid.

Referring now to FIG. 3, a sectional view of the device 10 taken along section line A-A (see FIG. 1), according to a preferred embodiment of the present invention. The flanges 50 extend horizontally outward from a bottom surface of the lower vessel section 22 to enable a user to easily transform the device 10 from the collapsed state to the expanded state, or visa-versa, by applying a force onto the flanges 50 in an opposite direction of expansion of the device 10 while lifting up or pressing down upon the upper vessel section 20.

The lid 30 is preferably affixed to a neck portion 40 of the upper vessel section 20 via a cylindrical threaded region 42.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be utilized as indicated in FIGS. 1 and 2.

The method of utilizing the device 10 may be achieved by performing the following steps: procuring a model of the device 10 having a desired internal volume 26; placing at least one (1) user's foot onto the flanges 50, preferably on either side of the device 10; applying a force to the flanges 50 opposite of the direction of expansion of the device 10; rotating and removing the lid 30; pulling up on the top mounted handle 38 to fully expand the container; filling the device 10 with a secondary liquid such as water to a desired level as indicated on the graduation portions 29 of the liquid level window 28 to produce an accurate mixture; replacing the lid 30; mixing the primary liquid and the secondary liquid within the device 10 by lifting and shaking the device 10 as necessary; and, benefiting from producing an accurate mixture and avoiding the use of additional containers to performing the mixing operation, afforded a user of the present invention 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A container, comprising:

a container body having a longitudinal axis and defining an interior volume, said container body comprising:
- an upper section;
- a lower section; and
- an expandable section between said upper section and lower section, said expandable section enabling said container body to expand and collapse along said longitudinal axis;

a window located along a side surface of said upper section for providing visual access to said interior volume;

a lid removably connected to said container body and providing access to an interior; and, four flanges connected to said container body at a lower edge of said lower section, each flange of said four flanges being located adjacent to one corner of said lower section, said each flange having a polygonal shape, in cross-section, and comprising an upper surface perpendicular to said longitudinal axis and configured to distribute a downward force, parallel to said longitudinal axis, applied to said flange by a human foot and a lower surface perpendicular to said longitudinal axis, opposed to said upper surface, and configured to distribute an upward force, opposite said downward force, parallel to said longitudinal axis, applied to said flange by a support surface, and wherein:

said container body expands about said expandable section in response to a tension force, parallel to said longitudinal axis, applied to said upper section and said downward force applied to said upper surface of said four flanges; and, said container body collapses about said expandable section in response to a compression force, parallel to said longitudinal axis, applied to said upper section and said upward force applied to said lower surface of said four flanges.

2. The container of claim 1, wherein when said container body is fully collapsed, said container body is capable of holding up to one-half of a liquid capacity as when fully expanded.

3. The container of claim 1, wherein said window comprises a plurality of molded measurement graduations.

4. The container of claim 1, wherein said window comprises a plurality of painted measurement graduations.

5. The container of claim 1, wherein said expandable section includes a plurality of integrally-molded parallel pleats.

6. The container of claim 1, comprising a handle within said upper section.

7. The container of claim 6, wherein said handle is "L" shaped.

8. The container of claim 6, wherein said handle is integrally formed within said upper section.

9. The container of claim 1, wherein said lid is threadingly affixed and sealed to a neck portion located at said top of said upper section.

* * * * *